US009756880B1

(12) United States Patent
Malik

(10) Patent No.: US 9,756,880 B1
(45) Date of Patent: Sep. 12, 2017

(54) DUAL USE BRA GARMENT FOR USER-SELECTED CONVERSION BETWEEN A CONVENTIONAL NURSING BRA CONFIGURATION AND A BREAST MILK ENGORGEMENT INHIBITING CONFIGURATION

(71) Applicant: Rabia Malik, Fort Lauderdale, FL (US)

(72) Inventor: Rabia Malik, Fort Lauderdale, FL (US)

( * ) Notice: Subject to any disclaimer, the term of this patent is extended or adjusted under 35 U.S.C. 154(b) by 157 days.

(21) Appl. No.: 14/675,982

(22) Filed: Apr. 1, 2015

(51) Int. Cl.
*A41C 3/00* (2006.01)
*A41C 3/04* (2006.01)
*A41C 3/12* (2006.01)

(52) U.S. Cl.
CPC ..... *A41C 3/04* (2013.01); *A41C 3/0035* (2013.01); *A41C 3/12* (2013.01)

(58) Field of Classification Search
CPC ..... A41C 3/00; A41C 3/005; A41C 3/0057; A41C 3/0064; A41C 3/04; A41C 3/12; A41C 1/10; A41C 1/12; A41C 3/02; A41D 13/1236; A41D 13/1245; A41D 2400/32; A41D 2400/38
USPC ..... 450/86, 88, 89, 36, 54–58
See application file for complete search history.

(56) References Cited

U.S. PATENT DOCUMENTS 1,448,639 A 3/1923 Reece
2,284,382 A * 5/1942 Elberfeld ..... A41C 3/00 450/62
2,607,038 A * 8/1952 Spare ..... A41C 3/0021 450/59
2,650,363 A 9/1953 Cascio
4,325,378 A * 4/1982 Wilkinson ..... A41C 3/02 450/58
4,444,191 A * 4/1984 Harned ..... A41C 3/0057 2/45
4,781,651 A 11/1988 Ekins
5,098,331 A * 3/1992 Corrado ..... A41C 3/0064 128/100.1

(Continued)

OTHER PUBLICATIONS

Shefit, The Ultimate Sports Bra, https://shefit.com/products/shefitultimatesportsbra?variant=14049516484, pp. 1-5, Copyright © 2016 Shefit®, Shefit, Inc.

(Continued)

*Primary Examiner* — Gloria Hale
(74) *Attorney, Agent, or Firm* — Glenn E. Gold, P.A.; Glenn E. Gold; David Colls

(57) ABSTRACT

A dual function, convertible bra garment includes a construction facilitating user-controllable conversion between a nursing bra configuration, readily usable during a conventional infant or young toddler nursing process, and a breast engorgement-inhibiting configuration. During use as a nursing bra, the garment is maintained in a first configuration, or state, providing direct access by a nursing child to a mother's nipple. Following a relatively simple highly-controllable conversion procedure, the nursing configuration is efficiently and effectively converted, generally based upon a combined elastic band strap-based system, for applying a user-selected uniform breast pressure, coupled with a user-controlled cooling component, and component carrying pocket, for indirectly communicating cooling to the wearer's breasts, thereby effecting complete conversion of the bra from a nursing configuration to a breast milk engorgement inhibiting configuration.

8 Claims, 9 Drawing Sheets

(56) References Cited

U.S. PATENT DOCUMENTS

| | | | | |
|---|---|---|---|---|
| 5,427,563 | A | 6/1995 | Manning | |
| 5,863,236 | A | 1/1999 | Johnson | |
| 5,968,003 | A | 10/1999 | Sisson | |
| 6,135,975 | A | 10/2000 | Johnstone | |
| 6,755,717 | B2 * | 6/2004 | Smith | A41C 3/0057 128/869 |
| 7,909,675 | B1 | 3/2011 | Rainey | |
| 8,317,569 | B2 * | 11/2012 | Fisher-Pacheco | A41C 3/10 450/58 |
| 8,858,295 | B2 * | 10/2014 | Thompson | A41F 15/002 450/10 |
| 8,900,032 | B2 * | 12/2014 | Punsal | A41C 3/0057 450/17 |
| 9,192,197 | B2 * | 11/2015 | Reinhard | A41C 3/0064 |
| 2009/0259159 | A1 * | 10/2009 | Bell | A41C 3/0064 602/75 |
| 2012/0028541 | A1 * | 2/2012 | Donnelly | A41C 3/0021 450/86 |
| 2013/0167284 | A1 | 7/2013 | Conner | |
| 2013/0316616 | A1 * | 11/2013 | Thompson | A41F 15/002 450/66 |
| 2015/0099420 | A1 * | 4/2015 | Reinhard | A41C 3/02 450/58 |

OTHER PUBLICATIONS

Breast Compression Garment.

* cited by examiner

DUAL USE BRA GARMENT FOR USER-SELECTED CONVERSION BETWEEN A CONVENTIONAL NURSING BRA CONFIGURATION AND A BREAST MILK ENGORGEMENT INHIBITING CONFIGURATION

FIELD OF THE INVENTION

The present invention relates generally to techniques for suppressing breast milk production and, more particularly, is concerned with a convertible bra garment serving the dual purposes of nursing and inhibiting engorgement of breasts with breast milk.

BACKGROUND OF THE INVENTION

A woman's breasts begin to develop and produce milk during the middle of her pregnancy, sometimes as early as 16 to 18 weeks into the pregnancy. The production of breast milk, commonly referred to as lactation, makes the breasts swell and feel engorged. The body will initiate this process early and it will continue to occur even in the case where a pregnancy ends unsuccessfully and, therefore, lactation is no longer needed or desired. The placenta makes hormones to stop milk production. When the placenta is gone, the hormone levels drop and the breasts start making milk.

Normally, suckling at the breast nipples provide signals to the breasts to let down milk already produced, and to continue to produce more milk. Absent suckling, there is no such demand and eventually the breasts will stop making more supply. However, if the milk already produced is not removed from the breasts, this can become very painful because of tightness and soreness associated with fully engorged breasts.

Unfortunately, it is not uncommon for a miscarriage to occur during the first or second trimester of a woman's pregnancy. In some instances when a miscarriage occurs, the woman's predisposition to produce milk is lost. However, without taking steps to attempt to limit, or altogether prevent milk production a condition commonly referred to as breast engorgement often occurs. In order to cease the production of new milk supply, it is crucial to prevent the very factors that tend to encourage milk production, commonly referred to as the "let-down" reflex or "lactation after loss." Application of pressure and support for the engorged breasts, and cooling to reduce breast swelling, are key to reducing the let-down reflex. Therefore, women who suffer from lactation after loss typically use a firm and snug bra that prevents the nipples from being stimulated, thereby reducing the lactation process. The constant diffuse pressure of a supportive bra will enable the beginning of signaling pathways in the breasts to inhibit milk production.

Therefore, there is a long felt, but as of yet unmet, for a more effective, easy-to-employ method for selectively inhibiting the let-down reflex. In particular, it would be highly desirable to provide a single bra garment that can be easily converted to selectively function as both a nursing bra and, where desired, a breast engorgement-inhibiting bra.

SUMMARY OF THE INVENTION

The present invention overcomes the deficiencies of past approaches and the problems that remain unsolved by providing a dual use bra garment for nursing and inhibiting breast engorgement. The bra garment includes a bra that can be employed for use in nursing, and attachments on the bra for use after nursing has ended to enable converting the bra for use in inhibiting breast engorgement by providing the desired breast support, cooling effect and diffuse pressure in a manner that will discourage milk production.

In one aspect of the present invention, a dual use bra garment includes:

- a bra configured for use in nursing, the bra including
  - a base band being annular in configuration,
  - a front side attached to and disposed above the base band, the front side including left and right breast cup portions,
  - a back side attached to and disposed above the base band,
  - a pair of shoulder straps respectively extending between and attached to the back side and upper parts of the left and right breast cup portions, and
  - left and right lateral sides attached to and disposed above the base band and interconnecting the front and back sides; and
- attachments on the bra that enable converting the bra for use in inhibiting breast engorgement, the attachments including
  - a pair of loops attached on the front side of the bra adjacent to one another so as to define a pair of slots spaced apart and extending side-by-side one another from between the left and right breast cup portions to proximate the base band, and
  - left and right connectors each attached proximate a respective one of the left and right lateral sides of the bra such that each of a pair of bands are attachable to one of the left and right connectors and coupleable to one of the loops via the slot thereof and extendible around the front of one of the left and right breast cup portions to convert the bra for use in inhibiting breast engorgement.

In another aspect of the present invention, the attachments also include another connector attached on the back side of the bra such that a wrap-around strap is attachable to the another connector and extendible around the left and right lateral sides of the bra and across the pair of bands on the front side thereof in opposite directions so as to secure to one another at a pair of free end portions of the wrap-around strap and apply pressure on the pair of bands.

In still another aspect of the present invention, a bra garment comprises:

- a bra including
  - a base band being annular in configuration,
  - a front side attached to and disposed above the base band, the front side including left and right breast cup portions,
  - a back side attached to and disposed above the base band,
  - a pair of shoulder straps respectively extending between and attached to the back side and upper parts of the left and right breast cup portions, and
  - left and right lateral sides attached to and disposed above the base band and interconnecting the front and back sides; and
- attachments on the bra that convert the bra to inhibiting breast engorgement, the attachments including left and right pockets formed in front of the left and right breast cup portions and configured to be openable and closable for receiving and retaining breast temperature reducing objects in proximity to the respective breast cup portions of the bra.

In another aspect of the present invention, the attachments also include left and right flaps on the front of said left and right breast cup portions that form the left and right pockets, the flaps having upper end portions releasably secured to the respective shoulder straps so as to at least partially open to allow fitting the breast temperature reducing objects into and removing them from the partially open pockets.

In yet another aspect of the present invention, the attachments also include a wrap-around strap configured to secure to the back side of the bra and to extend around the opposite lateral sides of the bra and across the front side thereof in opposite directions so as to overlap and secure to one another at a pair of free end portions of the strap and substantially cover and apply pressure on the pair of pockets formed in front of the left and right breast cup portions of the bra.

In still another aspect of the present invention, a bra garment comprises:

a bra including:

a base band being annular in configuration, a front side attached to and disposed above the base band, the front side including left and right breast cup portions, a back side attached to and disposed above the base band, a pair of shoulder straps respectively extending between and attached to the back side and upper parts of the left and right breast cup portions, left and right lateral sides attached to and disposed above the base band and interconnecting the front and back sides; and structural attachments integrated into the bra that convert the bra to an altered configuration tending to inhibit breast engorgement, the attachments including:

at least one loop attached on the front side of the bra so as to define a slot extending from between the left and right breast cup portions to proximate the base band, and at least one band anchored at one end portion to one of the left and right lateral sides of the bra and extending therefrom forwardly around one of the left and right breast cup portions adjacent to the one of the left and right lateral sides and through the slot of the one loop to an opposite free end portion of the one band that is folded back and releasably secured to another portion of the one band adjacent to the one loop and the opposite free end portion such that the at least one band covers and applies pressure on the one of the left and right breast cup portions of the bra.

In yet another aspect of the present invention, the at least one loop and at least one band are a pair of the loops and a pair of the bands, the one of the loops and one of the bands being applied relative to the one of the left and right lateral sides of the bra and the one of the left and right breast cup portions adjacent thereto and the other of the loops and the other of the bands being applied relative to the other of the left and right lateral sides of the bra and the other of the left and right breast cup portions adjacent thereto. Furthermore, each of the bands may be provided as a pair of narrower bands placed one above the other so that the bands may be individually releasably secured so as to substantially cover, and apply different levels of pressure to, upper and lower sections of the left and right breast cup portions of the bra.

In still another aspect of the present invention, the attachments also include a wrap-around strap configured to secure to the back side of the bra and to extend around the left and right lateral sides of the bra and across the front side thereof in opposite directions so as to overlap and secure to one another at a pair of free end portions of the strap and substantially cover and apply pressure on the pairs of narrower bands, and the pair of pockets formed in front of the left and right breast cup portions of the bra.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

Like reference numerals refer to like parts throughout the several views of the drawings.

DETAILED DESCRIPTION

Figure 1:
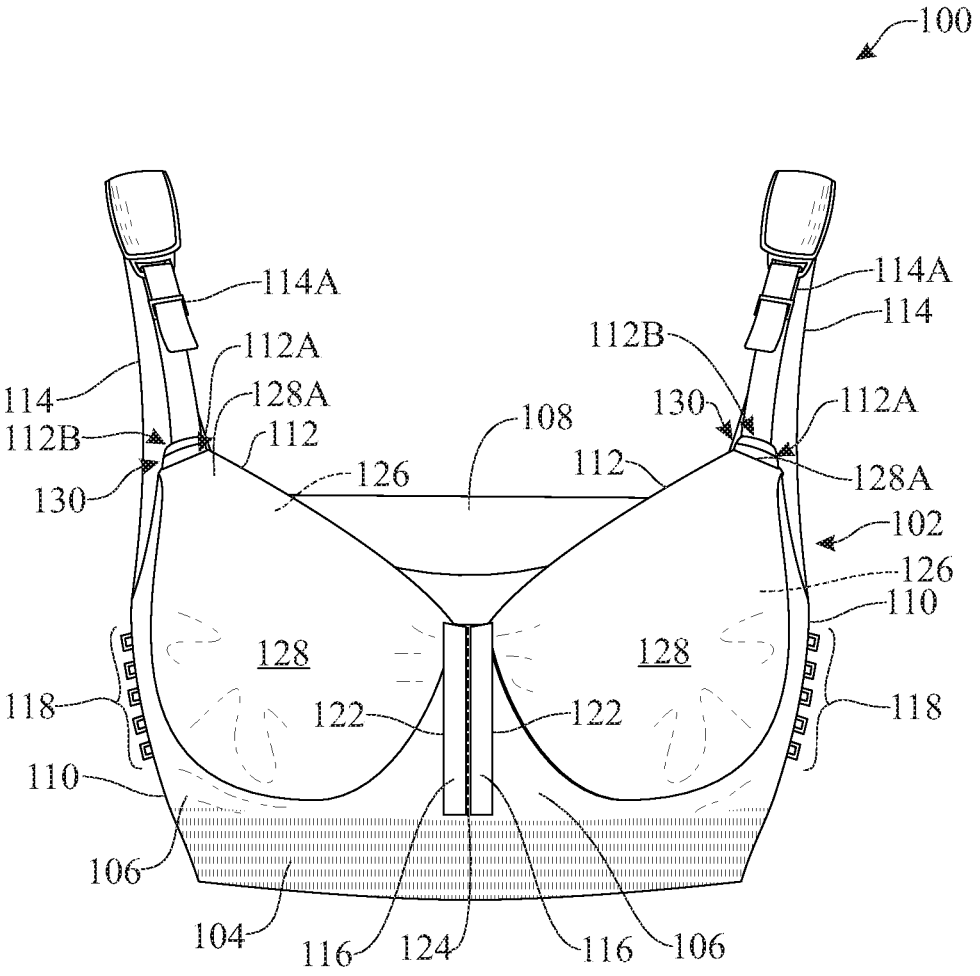
FIG. 1 presents a front elevation view of an exemplary embodiment of a bra garment in accordance with an aspect of the present invention, showing a bra that can be used for nursing and also having attachments thereon for converting the bra for use inhibiting breast engorgement.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Referring now primarily to FIGS. 1-3 and 6, there is illustrated a dual-function bra garment, generally designated by reference numeral 100, which has a construction enabling conversion between a "nursing" configuration and a "lactation-suppressing" configuration. The bra garment 100 includes a bra portion 102 that may readily be employed as a nursing bra by selectively releasing upper members 112B, located proximate to upper portions 112A of the respective left and right breast cups 112, from the shoulder straps 114 via releasable connector clips 130, in order to release flaps 128 overlying the breast cups, to selectively expose some or all of a woman's breast to enable the woman to nurse an infant. Upon completion of the use of the bra 102 during nursing, by employment of a plurality of interengageable components, in accordance with various aspects of the dual function convertible bra garment 100, the bra garment may be converted from the nursing configuration to a breast milk engorgement-inhibiting configuration. Various structural elements, components, and the like will be described hereinafter with reference to corresponding drawing FIGS. 1 through 9.

As best shown in FIGS. 1-3 and 6, the bra portion 102 of the convertible bra garment 100 generally includes a base band 104, a front side 106, a rear, or back, side 108, and left and right lateral sides (together referenced herein as reference numeral 110) interconnecting the front and back sides, 106 and 108, respectively. Base band 104 is contiguous with, and depends downwardly from, respective bottom portions of front side 106, back side 108 and lateral sides 110. The front side 106 includes left and right breast cup portions (together denoted by reference numeral 112). The base band 104 may have an endless, or contiguous, annular geometry, intended to completely circumscribe the torso of a wearer. The bra portion 102 will typically include a pair of shoulder straps (together denoted as reference numeral 114) extending between, and attached to, the back side 108 and upper parts 112A of the respective left and right breast cup portions 112. The shoulder straps 114 may include couplers 114A for facilitating adjustment of the shoulder strap lengths, for providing a comfortable fit and support, as is well known in the art. The various structural components of the bra portion 102 may be constructed of panels of conventional flexible fabric materials sewn or otherwise attached to one another. By way of example, but not of limitation, the fabric material of the base band 104 may be substantially elastic, while the other components may be constructed from fabric materials that are substantially inelastic.

Figure 6:
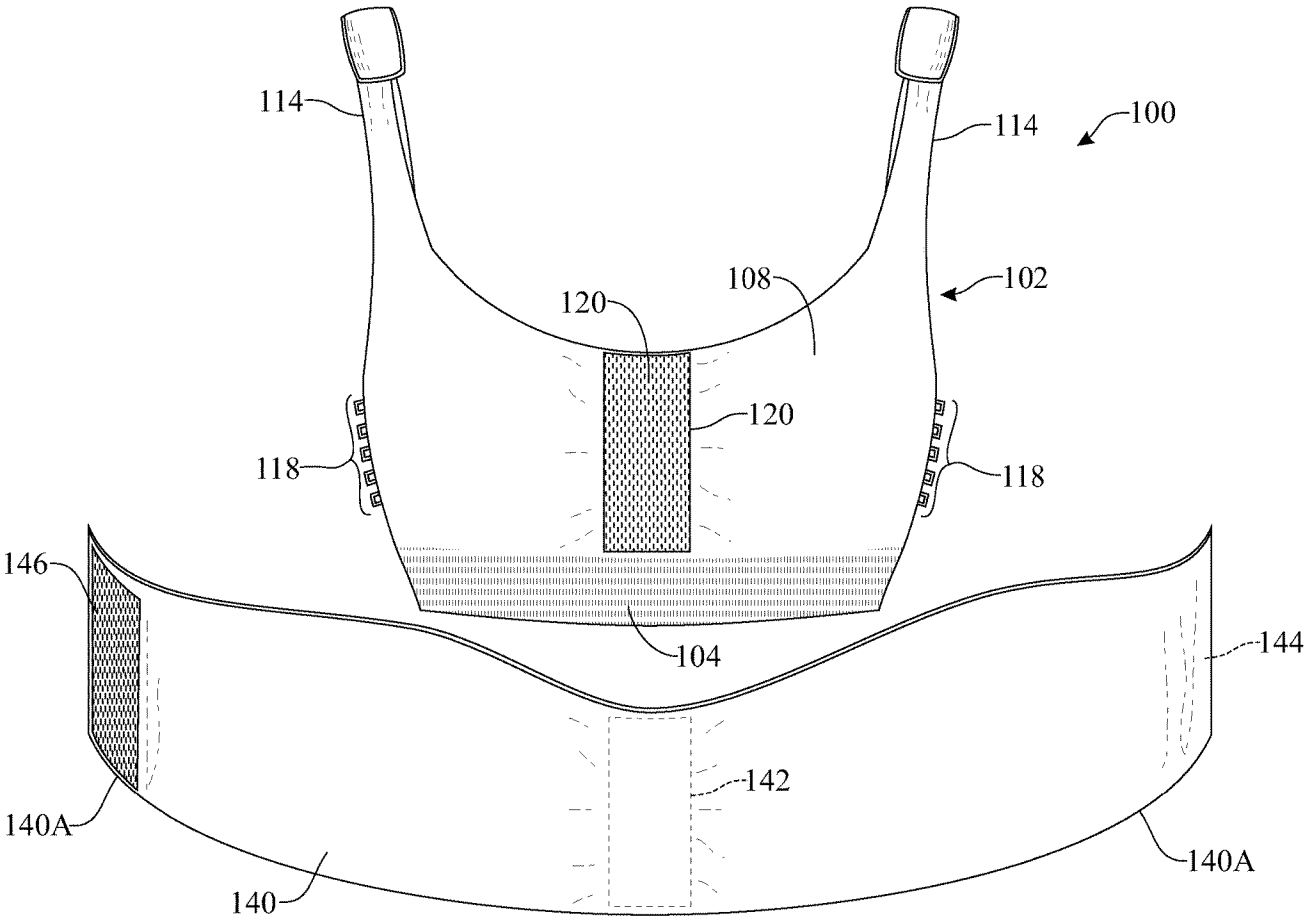
FIG. 6 presents a back elevation view of the bra garment of FIG. 1, now showing yet other attachments on the bra garment in the form of a wrap-around strap shown detached and separated from the bra garment.

Several of the attachments of the bra garment 100, which enable conversion of the bra 102 for use inhibiting breast engorgement, include a pair of loops (shown generally as reference numeral 116), left and right connectors (shown generally as reference numeral 118), and another, or third, connector 120 (shown in FIG. 6). The loops 116 may be in the form of strips of a flexible fabric material being attached at their opposite ends on the front side 106 of the bra 102 adjacent to one another. Together with the front side 106 of the bra 102, the loops 116 each define a band-receiving slot 122, they may be spaced-apart from one another, and they may extend adjacent, and generally parallel to, one another, preferably from between the left and right breast cup portions 112 to proximate the base band 104. For facilitating a wearer during the donning and removing the bra 102, a selectively-closable mechanism 124 (e.g., a conventional zipper, complementary rows of hooks and eyelets, etc.) may be incorporated on the front side 106 of the bra 102 between the pair of spaced-apart loops 116.

The left and right connectors 118 are attached to, and extend vertically on the left and right lateral sides 110 of, the bra 102, as seen in FIG. 1. As shown in FIG. 6, the third connector 120 is attached, preferably centrally, on the back side 106 of the bra 102. By way of example, and not of limitation, the left and right connectors 118 may be in the form of rows of eyelets, patches of selectively attachable and detachable material, conventionally known as "hook-and-loop material," and the like. The third connector 120, by way of example and not of limitation, may be a patch of the same attachable and detachable material.

Figure 2:
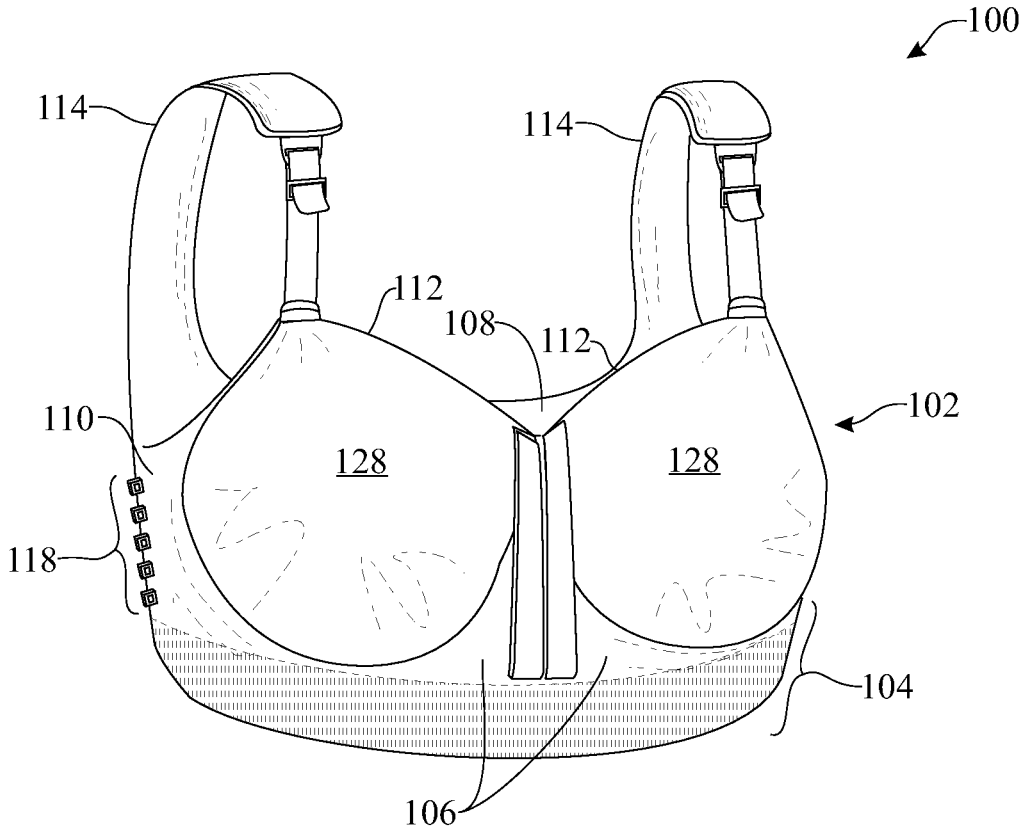
FIG. 2 presents a front isometric view of the bra garment as originally introduced in FIG. 1.
Figure 3:
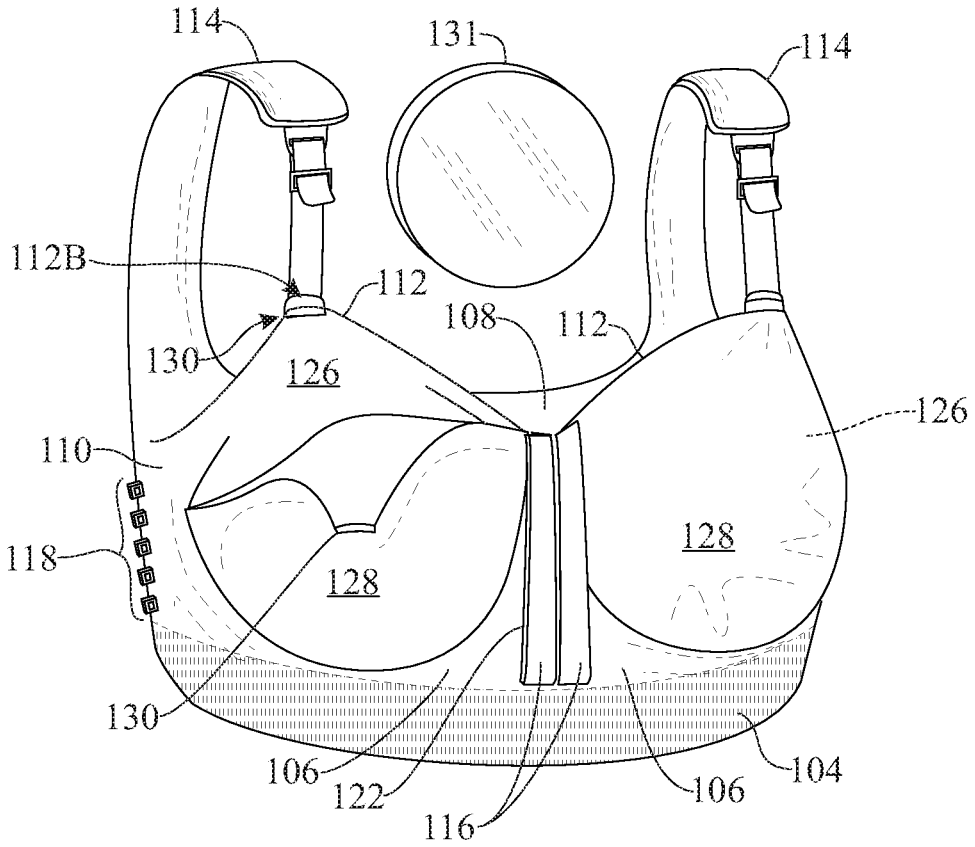
FIG. 3 presents a front isometric view of the bra garment of FIG. 2, now showing some attachments on the bra garment in the form of left and right flaps, which form left and right pockets, with one of the pockets being shown at least partially opened to selectively receive a temperature-reducing object.
Figure 4:
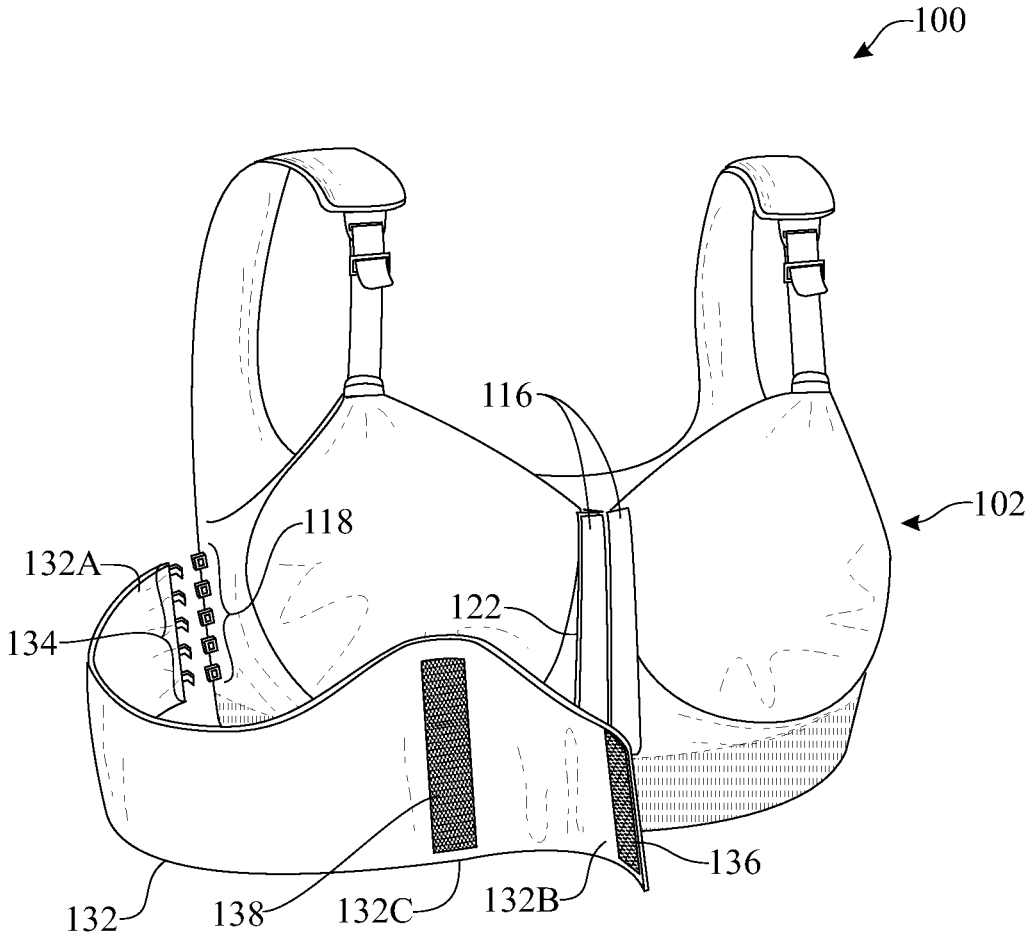
FIG. 4 presents a front isometric view of the bra garment of FIG. 2, now showing other attachments on the bra garment in the form of one band being detached from the bra garment.
Figure 5:
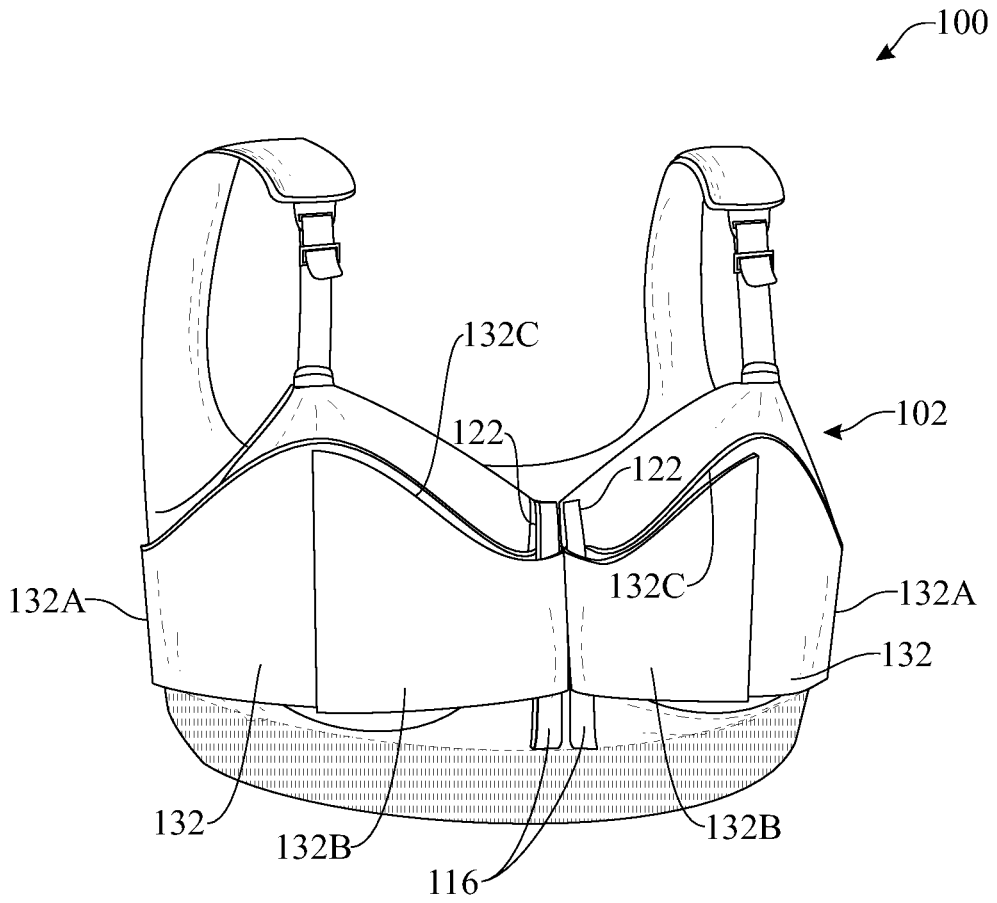
FIG. 5 presents a front isometric view of the bra garment of FIG. 2, now showing still other attachments on the bra garment in the form of a pair of bands.

As best shown in FIGS. 1-3, additional conversion-enabling features of the bra garment 100 preferably include left and right pockets (together, referred to herein by reference numeral 126) formed in front of, or otherwise overlaying, the respective left and right breast cup portions 112 on the front side 106 of the bra portion 102. The left and right pockets 126 are created and defined by respective left and right flaps (together referred to herein by reference numeral 128 partially attached to the exterior surface of the front of the corresponding left and right breast cup portions 112. The left and right flaps 128 may have upper end portions 128A that are releasably secured to the respective forward ends of the shoulder straps 114 by clips 130, such that at least the upper end portions 128A of the left and right flaps 128 may be selectively released from the respective shoulder straps 114 to at least partially open the respective pockets 126 in order to receive therein, and remove therefrom, a breast temperature-reducing object 131 for maintaining the cooling object 131 in close proximity to, and preferably against, the respective breast cup portions 112 of the bra body 102. The temperature-reducing object 131 may be any object or material currently in existence or developed in the future, which can be easily cooled and subsequently maintained at a desired cooling temperature, while contained in the pocket. However, it is preferred to use an object, such as a gel-filled or hydrogel-filled breast cooling pad, wherein the cooling material is enveloped or contained within a flexible leak-proof enclosure to prevent seepage of gel or liquid, and wherein the containment material has adequate flexibility to easily adapt or conform to the changing contour of the overlaid breast. As desired, it is contemplated to utilize any convenient cooling object construction or configuration that serves the intended function of the invention. For instance, while the cooling component 131 is shown having a generally circular pad or puck-like geometry, it will be apparent to those skilled in the art that the specific geometry and construction of the cooling component may take on any of a myriad of variations without departing from the intended scope of the invention. By way of example, but not limitation, it is contemplated to incorporate an annular, or donut-shaped, configuration which, when properly inserted and seated within the pocket, avoids cooling contact with the nipple and surrounding areola, while making indirect cooling contact with the surrounding breast skin Referring now primarily to FIGS. 4 and 5, other conversion-enabling and conversion-facilitating components of the convertible bra garment 100 may include at least one (and preferably a pair of) pressure-applying band(s) 132. Each band 132 is selectively attachable to a respective one of the left and right connectors 118 (shown in FIG. 1). More specifically, each band 132 has a first end portion 132A incorporating a connector 134 complementary to the left and right connectors 118 disposed along the respective left and right lateral sides (shown generally as reference numeral 110) of the bra portion 102. The complementary connectors 134, by way of example but not of limitation, may be in the form of a series of hooks as shown) or, alternatively, patches of mateable portions of a hook-and-loop attachment system. The pressure-applying bands 132, selectively and releasably anchored at the respective left and right lateral sides 110 of the bra portion 102, are then extended forwardly around the front of the respective left and right breast cup portions 112, for selective engagement with the respective loops 116 via insertion of corresponding free ends 132B of the pressure-applying bands 132 through the respective band-receiving slots 122 formed by the loops 116, in order to convert the bra garment 100 for use inhibiting breast engorgement through application of pressure (in conjunction with application of cooling) to the breasts. More specifically, a second, opposite, free distal end portion 132B of each pressure-applying band 132 is inserted through the respective slot 122 of a respective one of the loops 116, and subsequently folded back upon itself, for releasable attachment to another less distal portion 132C of the band 132 adjacent to the loop 116, such that the bands cover, and apply the desired pressure to, the left and right breast cup portions 112 and thus, the underlying breasts). As best shown in FIG. 4, the distal free end portion 132B and portion 132C adjacent thereto have complementary connectors 136, 138 thereon, such as mating patches of hook-and-loop material, for selectively releasably attaching the portions 132B, 132C of each band 132 to one another. In this manner, each band 132 can be independently adjusted (i.e., tightened or loosened) to selectively apply the desired degree of pressure. Furthermore, the bands 132 preferably have configurations that substantially conform to the corresponding configurations of the left and right breast cup portions 112, such that the bands will cover substantially all of the breast cup portions 112 and, accordingly, the milk ducts of the wearer's breasts, in condition for the application of pressure to more effectively cease milk production. Significantly, each pressure-applying band 132 incorporates a band width, along a length of the band that is generally aligned with a corresponding bra cup once the band is tightened, adequate to substantially cover a corresponding bra cup. Furthermore, it will be noted that the bands 132 may be woven through, behind the flaps 128, through the pockets 126, to the loops 116, so as to reduce any bulkiness that might be present when routed in front of the flaps 128.

Figure 7:
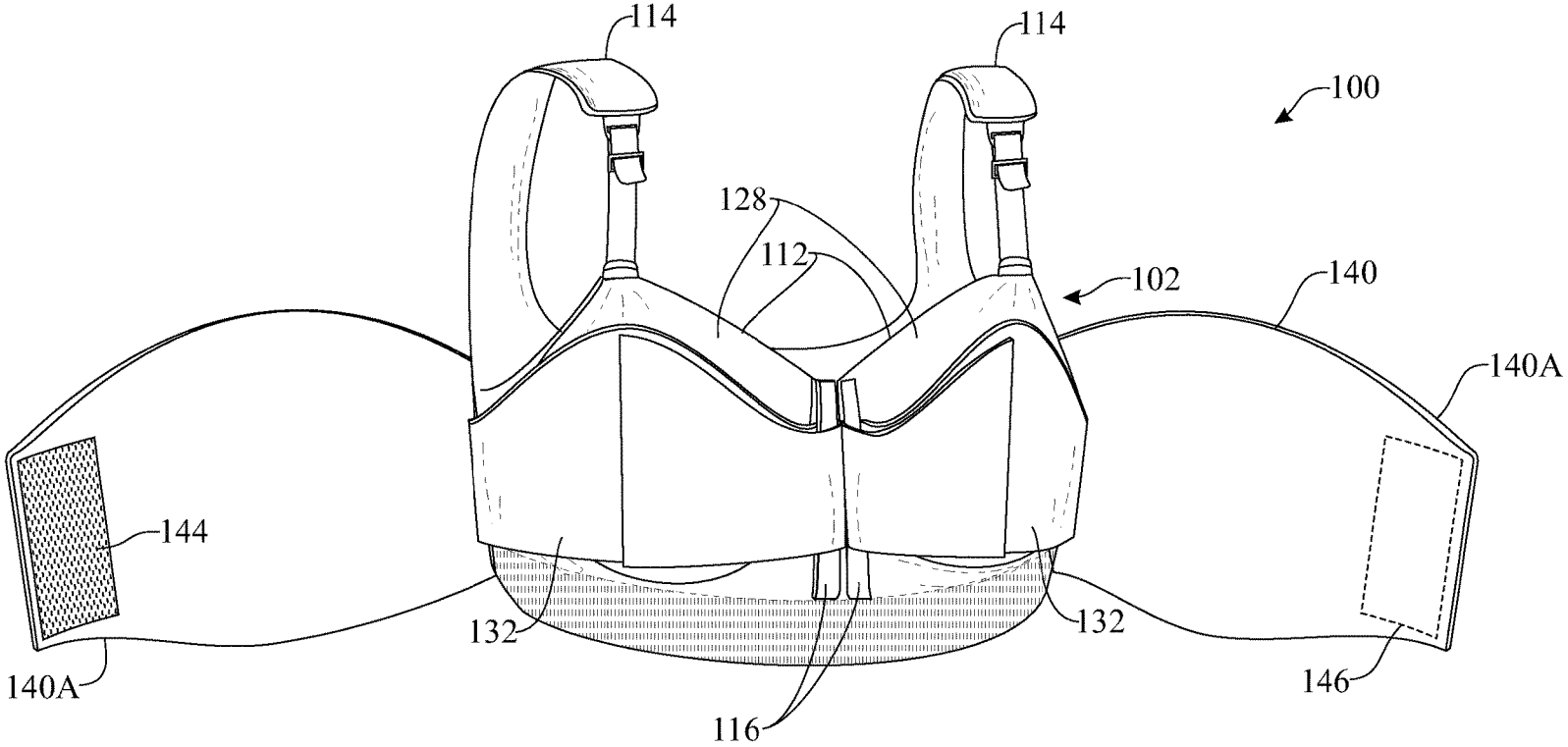
FIG. 7 presents a front isometric view of the bra garment with the attachments of FIGS. 5 and 6 being shown together on the bra garment with the wrap-around strap in an opened position.
Figure 8:
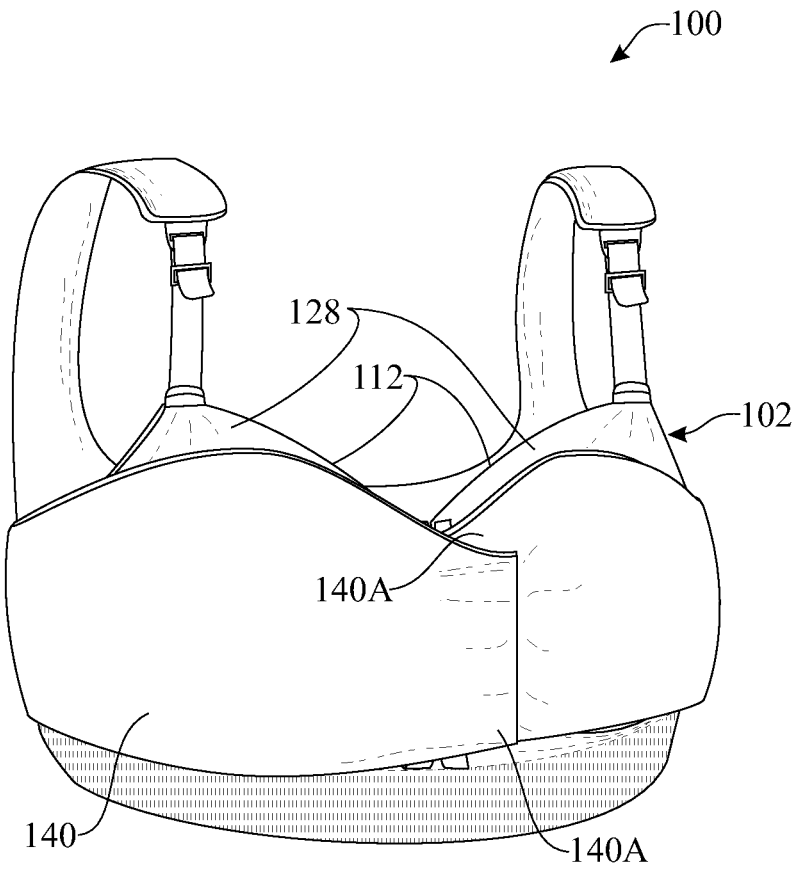
FIG. 8 presents a front isometric view of the bra garment as seen in FIG. 7, but now showing the wrap-around strap in a closed position.

Referring now to FIGS. 6-8, still another conversion-enabling attachment of the bra garment 100 includes a pressure applying wrap-around strap 140. The wrap-around strap 140 has a complementary connector 142 centrally located between opposite free end portions 140A of the wrap-around strap 140. The complementary connector 142 attaches to the third connector 120 on the back side 108 of the bra 102. The strap 140 is of sufficient length to extend in opposite directions away from the mated connectors 120, 142, around the left and right lateral sides 110 of the bra 102, along the bands 132 on the front side 106 of the bra 102, so as to overlap and secure to one another at the free end portions 140A of the strap 140, substantially covering and applying pressure upon the bands 132, and the left and right flaps 128 forming the left and right pockets 126 on the front of the left and right breast cup portions 112 of the bra 102. The overlapped opposite free end portions 140A of the wrap-around strap 140 have connectors 144, 146 complementary to one another and attached at respective opposite sides thereof. The connectors 144, 146 secure the overlapped free end portions 140A of the strap 140 to one another. The complementary connectors 144, 146, by way of example but not of limitation, may be complementary patches of hook-and-loop material.

Figure 9:
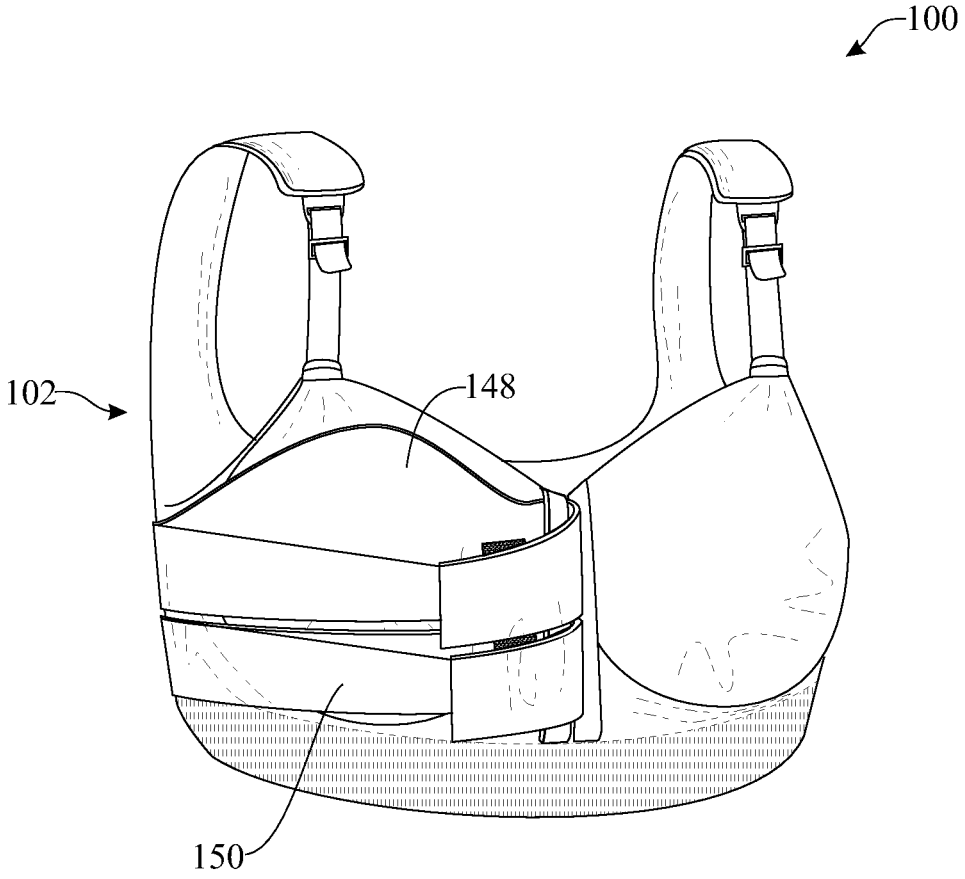
FIG. 9 presents a front isometric view of the bra garment similar to FIG. 4, but incorporating a pair of bands applied on the bar garment in place of the one band shown in FIGS. 1-8.

Referring now primarily to FIG. 9, but in conjunction with FIGS. 1-8, in lieu of each band 132 shown in FIGS. 1-8, a pair of bands 148, 150 (FIG. 9) may be employed. Each one of the pair of bands 148, 150 is located directly above or below the respective other band 148, 150, such that each one of the bands 148, 150 is independently releasably secured in a manner substantially covering, and adjustable to selectively apply varying degrees of pressure to, upper and lower sections of a respective one of the left and right breast cup portions of the bra.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims. For example, although the aforementioned Figures and description primarily illustrate and describe adjustable strap-through-loop type fastening systems, it will be apparent to those skilled in the art that, alternatively, a lattice type construction/arrangement could be employed, whereby individual laterally extending straps are interwoven through spaced apart slits forming channels therebetween integrated into, for instance, an exterior layer of the bra 102, in order to provide the desired uniform pressure application about the breast cup covering a wearer's breasts. Still further, in lieu of a laterally-disposed strap system, a pair of crisscrossing elastic straps could be disposed extending between two vertically-extending rows of corset style lacing disposed outside of, and thereby bounding, the leftmost and rightmost cup region of the bra, whereby the elastic straps extend around an exterior cup perimeter, crisscrossing at a central medial axis between the cup regions, and wherein a cooling element is provided for selective receipt within pockets formed upon, or otherwise integrated into, cup portions. Various combinations of the exemplary implementations are also contemplated to be employed to achieve the desired invention, which in the broadest sense is comprised of a dual function nursing and engorgement-inhibiting bra garment, providing the wearer with both: (1) direct selective access to the covered breast during use as a nursing bra; and, following a simple conversion process; (2) a combination of selective indirect communication of a cooling temperature from an insertable cooling device to an exterior breast surface, and an adjustable generally uniform pressure application against the exterior breast surface via an elastic strap system, which incorporates a novel and nonobvious construction and configuration that functions to facilitate conversion between the aforementioned conventional nursing bra configuration and a user-deployed adjustable substantially uniform cooling temperature and pressure application against the wearer's breasts, adequate to effectively minimize, and preferably cease, the so-called letting down reflex.

What is claimed is:

1. A dual function bra garment, convertible from a first nursing bra configuration to a second breast milk engorgement-inhibiting configuration, the convertible dual function bra garment comprising:

a bra body portion including a front side, a rear side and a pair of right and left lateral sides adjoining said front and rear sides, and a pair of left and right breast cup portions integrated into the front side of said bra body portion, said right and left lateral sides each having a first part of a coupling system disposed thereon, a portion of said front side between said left and right breast cup portions having a pair of adjacent loops provided thereon;

a contiguous elastic base band having an annular configuration, said base band contiguous with, and depending downwardly from, a lower portion of said bra body portion;

a pair of shoulder straps, each shoulder strap having a length extending between, and attached at opposite strap length ends to, said bra body portion rear side and an upper portion of a respective one of said left and right breast cup portions, each corresponding strap end attached to a respective one of said left and right breast cup portions having a first part of a mechanical coupling mechanism attached thereto;

a pair of right and left flaps, each flap disposed over a corresponding respective one of said right and left bra body breast cup portions, an upper portion of each said flap having a second part of a mechanical coupling mechanism attached thereto and configured for releasable attachment to the first part of said mechanical coupling mechanism attached to a respective one of said shoulder strap length ends, each flap forming a pocket between an interior flap surface and a bra body portion breast cup exterior surface;

at least one pressure-applying band having a band length extending between first and second pressure-applying band ends, the first end of said band length having integrated therewith a second part of a coupling system configured for releasable attachment to said coupling system first part disposed upon said respective left and right bra body lateral sides, the second end of said band length having an attachment feature disposed thereon for enabling said second end to be folded backward upon itself for selective attachment to itself;

a cooling object sized, shaped and otherwise configured for being snugly received within one of said pockets formed between an interior flap surface and a bra body breast cup exterior surface;

wherein, during use of said dual function bra garment as a nursing bra, at least one of said pair of right and left flaps may be lowered by decoupling its respective mechanical coupling mechanism second part from the corresponding mechanical coupling mechanism first part attached to said respective one of said shoulder strap length ends; and wherein, upon converting said dual function bra garment from said nursing configuration to said breast milk engorgement-inhibiting configuration:

said cooling object is provided seated within one of said pockets formed between an interior flap surface and a bra body portion breast cup exterior surface and the mechanical coupling mechanism second part attached to said flap upper portion is coupled to a corresponding mechanical coupling mechanism first part attached to a corresponding shoulder strap end, thereby snugly containing said cooling object within said pocket;

said second part of said coupling mechanism integrated with the first end of said elastic pressure-applying band is coupled to the coupling mechanism first part disposed upon a lateral side of said bra body; and said second end of said elastic pressure-applying band is extended forwardly over said respective flap, bra body breast cup and cooling object seated within the pocket formed therebetween, inserted through one of said pair of adjacent loops, looped back around said one of said adjacent loops, folded backward upon itself and attached to itself via the attachment feature disposed upon the second end of said band length, thereby exerting a desirable degree of pressure against said cooling object in order to enable the cooling object to cool the corresponding breast of a wearer of the dual function bra garment.

2. A dual function bra garment as recited in claim 1, further comprising:

an auxiliary pressure-applying band having a length extending between first and second opposite ends, a front surface and a rear surface, the front surface having a first half of a first releasable selective attachment system disposed thereon proximate to a midpoint of the band length, and a first half of a second releasable selective attachment system disposed upon said front surface proximate to said first end, the rear surface of said auxiliary pressure-applying band having a second half of said second releasable selective attachment system disposed thereon proximate to said second end; and a second half of said first releasable selective attachment system disposed upon an exterior surface of the rear side of said bra body portion, wherein said first half of said first releasable selective attachment system is releasably attached to said second half of said first releasable selective attachment system, said first and second ends of said auxiliary pressure-applying band are extended forwardly and wrapped around said elastic pressure-applying band, and the first half of said second releasable selective attachment system is releasably attached to the second half of the second releasable selective attachment system, such that said auxiliary pressure-applying band functions to exert additional pressure upon said cooling object.

3. A dual function bra garment as recited in claim 1, further comprising a closure mechanism integrated into the front side of said bra body portion between said pair of adjacent loops, said closure mechanism openable and closeable to facilitate a wearer while donning said bra and removing said bra off.

4. A dual function bra garment as recited in claim 1, wherein said cooling object further comprises a contained volume of at least one of a gel composition and a hydrogel composition.

5. A dual function bra garment, convertible from a first nursing bra configuration to a second breast milk engorgement-inhibiting configuration, the convertible dual function bra garment comprising:

a bra body portion including a front side, a rear side and a pair of right and left lateral sides adjoining said front and rear sides, and a pair of left and right breast cup portions integrated into the front side of said bra body portion, said right and left lateral sides each having an attachment feature integrated therewith, a portion of said front side between said left and right breast cup portions having at least one loop provided thereon;

a contiguous elastic band portion depending downwardly from a bottom portion of said bra body portion and contiguous therewith;

a pair of shoulder straps each having opposite ends attached to a said bra body portion rear side and a respective one of said breast cup portions;

a pair of flaps each disposed upon an exterior surface of a respective one of said breast cup portions and each having a flap peripheral edge portion partially attached to said respective breast cup portion exterior surface, thereby defining a receiving pocket between said respective breast cup portion and overlying flap, an upper portion of each flap having a selective coupling feature configured for selective engagement with a mating attachment feature of one of said pair of shoulder straps and said bra body;

a pressure-applying band length having opposite ends, a first end having a selective coupling feature configured for selective engagement with a mating attachment feature provided upon one of the lateral sides of said bra body, and a second end having a self-attachment mechanism for enabling a portion of said band proximate said second end to be folded back upon itself and selectively attached thereto; and a cooling object sized, shaped and otherwise configured for being snugly received within said receiving pocket, wherein, during use, said dual function bra garment is convertible between a nursing bra configuration and a breast milk engorgement-inhibiting configuration.

6. A dual function bra garment as recited in claim 5, further comprising:

an auxiliary pressure-applying band having a length extending between first and second opposite ends, a front surface and a rear surface, the front surface having a first half of a first releasable selective attachment system disposed thereon proximate to a midpoint of the band length, and a first half of a second releasable selective attachment system disposed upon said front surface proximate to said first end, the rear surface of said auxiliary pressure-applying band having a second half of said second releasable selective attachment system disposed thereon proximate to said second end; and a second half of said first releasable selective attachment system disposed upon an exterior surface of the rear side of said bra body portion.

7. A dual function bra garment as recited in of claim 5, further comprising a closure mechanism integrated with a central portion of the front side of said bra body portion, said closure mechanism selectively openable and closeable to facilitate a user while donning said bra garment and subsequently removing said bra garment.

8. A dual function bra garment as recited in claim 5, wherein said cooling object further comprises a contained volume of at least one of a gel and a hydrogel composition.

* * * * *